US007366603B2

(12) United States Patent
McDaniel

(10) Patent No.: US 7,366,603 B2
(45) Date of Patent: Apr. 29, 2008

(54) METHOD OF DECODING A CAM SIGNAL FOR AN INTERNAL COMBUSTION ENGINE

(75) Inventor: Christopher Irving McDaniel, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/493,806

(22) Filed: Jul. 26, 2006

(65) Prior Publication Data

US 2008/0027622 A1 Jan. 31, 2008

(51) Int. Cl.
*G06G 7/70* (2006.01)

(52) U.S. Cl. ..... 701/102; 123/480

(58) Field of Classification Search ..... 701/102, 701/105, 109, 114, 115; 123/478, 479, 480, 123/406.58, 406.62; 73/116, 117.3; 700/29
See application file for complete search history.

(56) References Cited

U.S. PATENT DOCUMENTS

| | | | | |
|---|---|---|---|---|
| 5,079,945 | A * | 1/1992 | Hansen et al. | 73/116 |
| 6,445,998 | B2 * | 9/2002 | Ando | 701/114 |
| 6,721,648 | B2 * | 4/2004 | Masters et al. | 701/110 |
| 6,775,611 | B2 * | 8/2004 | Kobayashi et al. | 701/114 |
| 7,181,333 | B2 * | 2/2007 | Sheikh et al. | 701/105 |

* cited by examiner

*Primary Examiner*—Willis R. Wolfe
*Assistant Examiner*—Johnny H. Hoang
(74) *Attorney, Agent, or Firm*—Jimmy L. Funke

(57) ABSTRACT

The CAM signal of a four-stroke internal combustion engine that also includes a CRANK signal having a sync feature is decoded by defining an observation window of predefined duration with respect a pulse transition of the CAM signal. The CAM signal is uniquely decoded during the observation window by monitoring for a pulse transition of the CAM signal and the sync feature of the CRANK signal.

3 Claims, 3 Drawing Sheets

| CRANK GAP DETECTED? | RISING EDGE OF CAM DETECTED? | POSITION OF LAST PULSE |
|---|---|---|
| NO | NO | 1 |
| YES | YES | 2 |
| NO | YES | 3 |
| YES | NO | 4 |

METHOD OF DECODING A CAM SIGNAL FOR AN INTERNAL COMBUSTION ENGINE

TECHNICAL FIELD

The present invention relates to a method of decoding the camshaft position signal of a four-stroke internal combustion engine.

BACKGROUND OF THE INVENTION

The control of fuel and spark events in an internal combustion engine requires knowledge of the engine cycle position. A common approach with four-stroke engines is to develop a high-resolution position signal (CRANK) based on rotation of the engine crankshaft (which rotates twice per engine cycle), and a low-resolution position signal (CAM) based on rotation of the engine camshaft (which rotates once per engine cycle). In this case, the CRANK signal is used for fuel and spark timing, and the CAM signal is used to synchronize the CRANK signal with the engine cycle position.

Conventional engine position decoding methodologies require one or more revolutions of the crankshaft in order to synchronize the CAM signal with the engine cycle position. FIG. 1 depicts a conventional decoding configuration for an eight-cylinder engine. In the illustrated example, the radial periphery of a crank-wheel attached to the crankshaft is provided with 58 teeth and a sync feature in the form of an 18° notch or gap, and the radial periphery of a cam-wheel attached to the camshaft is provided with four width-encoded teeth. The CRANK signal of Graph A is developed by a first magnetic position sensor responsive to movement of the crank-wheel teeth, and the CAM signal is developed by a second magnetic position sensor responsive to movement of the cam-wheel teeth. The CRANK signal of Graph B is decoded during engine rotation (cranking) by detecting the 18° pulse gap (referred to herein as a sync pulse), and the CAM signal is concurrently decoded by evaluating the pattern of long and short pulse widths. The relationship between the 18° sync pulse of the CRANK signal and the corresponding state (i.e., high or low) of the CAM signal synchronizes the CRANK signal with the engine cycle position. Once the CRANK and CAM signals are decoded and synchronized with the engine cycle, the engine controller can provide the correct fuel and spark controls for starting the engine. Unfortunately, decoding the CAM signal based just on the pulse width pattern can require anywhere from 360° to 540° of crankshaft rotation, depending on the initial position of the engine. Accordingly, what is desired is a CAM signal decoding methodology that uses conventional crank and cam tooth encoding but provides faster decoding for more prompt engine starting.

SUMMARY OF THE INVENTION

The present invention provides an improved method of decoding a CAM signal of a four-stroke internal combustion engine that also includes a CRANK signal having a sync feature. An observation window of predefined duration is defined with respect a pulse transition of the CAM signal, and the CAM signal is uniquely decoded within a single observation window by monitoring for a pulse transition of the CAM signal and a sync feature of the CRANK signal.

DESCRIPTION OF THE PREFERRED EMBODIMENT

Figures 2, 4:
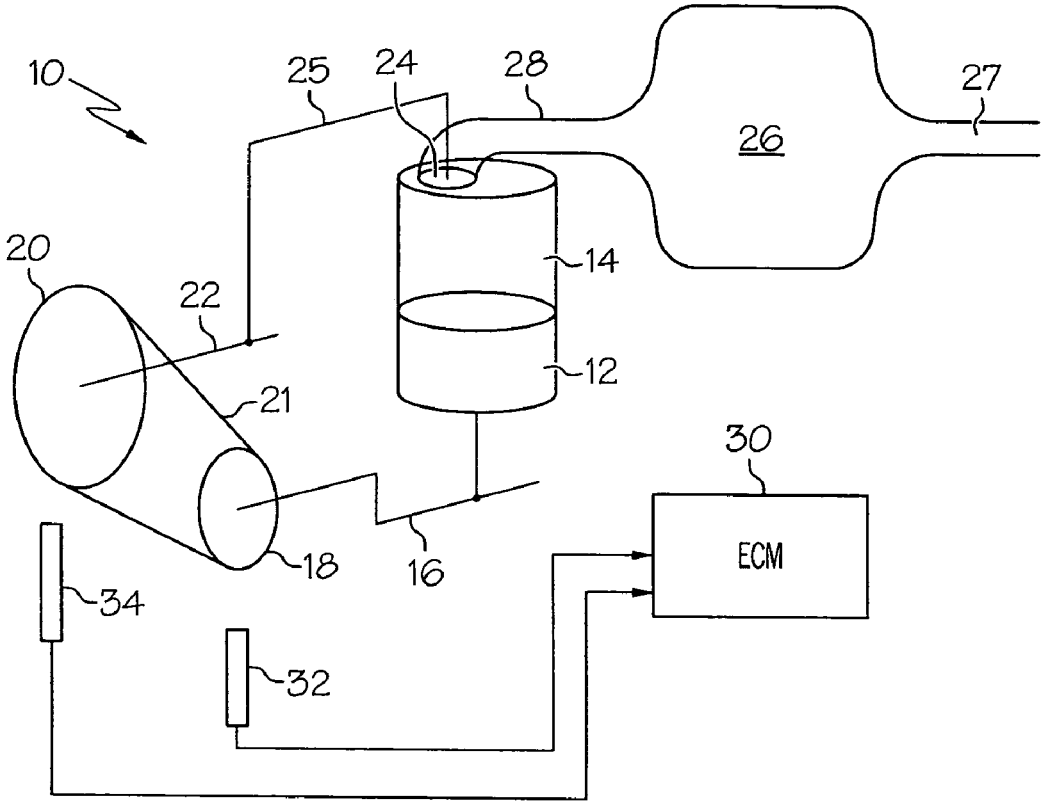
FIG. 2 is a diagram of a four-stroke internal combustion engine and an engine control module (ECM) for carrying out the CAM signal decoding method of the present invention.
FIG. 4 is a table depicting decode logic carried out by the ECM of FIG. 2 according to this invention.

Referring to FIG. 2, the present invention is disclosed in the context of an eight-cylinder four-stroke internal combustion engine, generally designated by the reference numeral 10. The engine 10 includes a set of eight pistons 12 (only one of which is shown) which reciprocate in respective cylinders 14 and are connected to crankshaft 16. The crankshaft 16 is connected to the crank-wheel 18, which is mechanically coupled to a cam-wheel 20 by a belt or chain 21 so that the crank-wheel 18 and the cam-wheel 20 rotate synchronously. The cam-wheel 20 is connected to a camshaft 22, which opens and closes a cylinder intake valve 24 through a mechanical linkage 25 in coordination with the movement of piston 12. Intake air enters an intake manifold 26 through a throttle passage 27, and is delivered to each of the cylinders 14 via a respective intake runner 28 and intake valve 24. Obviously, engine 10 includes many other component parts such as exhaust valves that are also conventional and known in the state of the art to be part of an operational engine.

A microprocessor-based engine control module (ECM) 30 controls the timing of various engine cycle-related events (including fuel injection and spark timing, for example) based on a CRANK signal produced by a first sensor 32 responsive to the rotation of crank-wheel 18 and a CAM signal produced by a second sensor 34 responsive to the rotation of cam-wheel 20. Typically, the outer peripheries of crank-wheel 18 and cam-wheel 20 are toothed, and the sensors 32 and 34 are variable reluctance or similar sensors that produce electrical pulses corresponding to movement of the teeth. In the illustrated embodiment, crank-wheel 18 is provided with a set of fifty-eight teeth and an 18° notch or gap, resulting in the CRANK signal depicted in Graph A of FIG. 1; and cam-wheel 20 is provided with a set of four width-encoded teeth, resulting in the CAM signal depicted in Graph B of FIG. 1.

As described above in respect to FIG. 1, the CAM signal is traditionally decoded by evaluating the pattern of long and short pulse widths. For example, CAM pulse #1 can be uniquely identified as a short pulse preceded by a long pulse. Similarly, CAM pulse #2 can be uniquely identified as a short pulse preceded by a short pulse; CAM pulse #3 can be uniquely identified as a long pulse preceded by a short pulse; and CAM pulse #4 can be uniquely identified as a long pulse preceded by a long pulse. Three state transitions of the CAM pulse are required to decode the CAM signal in this way, which corresponds to one full rotation of crank-wheel 18 or one-half rotation of cam-wheel 20. However, the decoding can require up to 540° of crankshaft rotation, depending on the initial engine position.

The present invention is directed to a method of more quickly decoding the CAM signal by detecting the presence or absence of a CRANK signal sync pulse within an observation window defined with respect to a CAM signal pulse. In the illustrated embodiment, the observation windows begin at a pulse transition of CAM signal and end after the crank-wheel 18 has rotated through a predetermined angle. Alternatively, or in addition, the observation windows can be configured to begin subsequent to a pulse transition of CAM signal, or even prior to a pulse transition of CAM signal, so long as the CAM signal state and CRANK signal sync pulse can be detected during the observation window.

Figure 1:
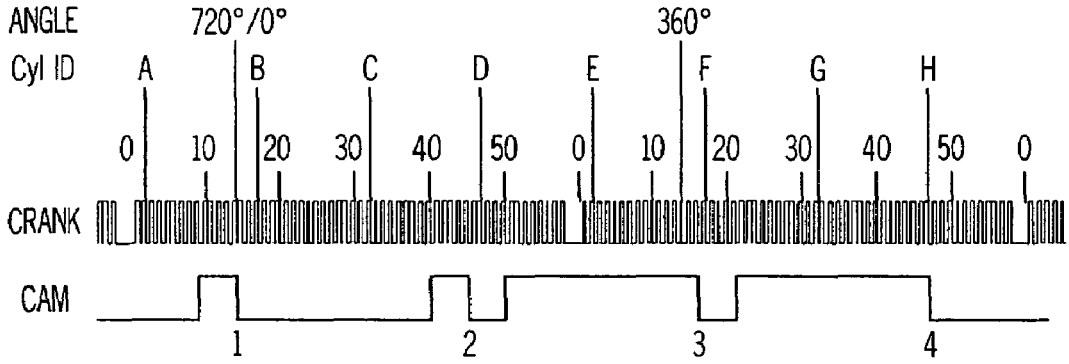
FIG. 1, Graphs A and B, respectively depict conventional CRANK and CAM signals for a four-stroke internal combustion engine.
Figure 3:
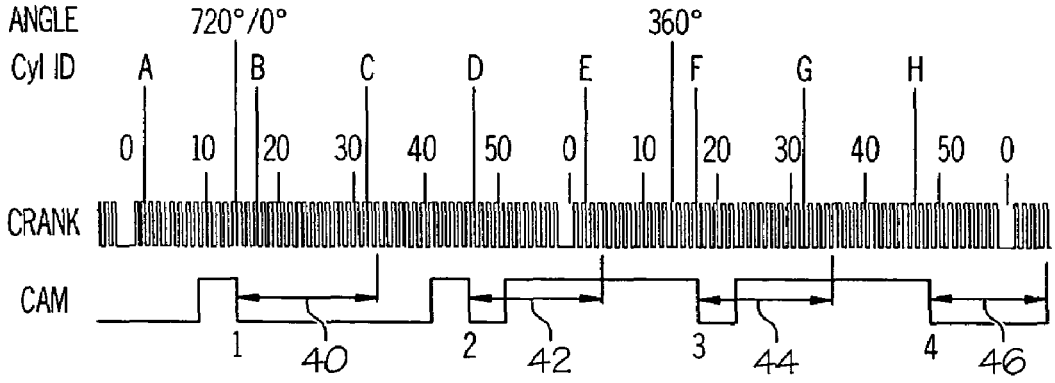
FIG. 3, Graphs A and B, respectively depict the CRANK and CAM signals of FIG. 1, along with observation windows defined according to the present invention.

Graphs A and B of FIG. 3 respectively reproduce the CRANK and CAM signals of FIG. 1, along with a set of observation windows 40-46. The observation windows 40-46 each begin at the falling edge of a CAM signal pulse, and each has a period equal to approximately 102° of crankshaft rotation (i.e., a rotation interval defined by 17 teeth of the crank-wheel 18). Observation window 40 begins at the falling edge of CAM pulse #1; observation window 42 begins at the falling edge of CAM pulse #2; observation window 44 begins at the falling edge of CAM pulse #3; and observation window 46 begins at the falling edge of CAM pulse #4. Since the CRANK signal has a sync pulse and CAM signal has width-encoded pulses (short-short-long-long in the illustrated embodiment), a unique combination of CAM signal transitions and CRANK signal sync pulses occurs in each of the observation windows. Observation window 40 contains no CAM signal transition and no CRANK signal sync pulse; observation window 42 contains a CAM signal transition and a CRANK signal sync pulse; observation window 44 contains a CAM signal transition but no CRANK signal sync pulse; and observation window 46 contains a CRANK signal sync pulse but no CAM signal transition. This pattern is illustrated in the table of FIG. 4, demonstrating that only one observation window is required to uniquely decode the CAM signal. In applications where the phase angle between the CAM signal and the CRANK signal is known, the CRANK signal can be simultaneously decoded by applying the phase angle to the decoded CAM signal position.

Depending on the starting position of the cam-wheel 20, the cam decoding process can take anywhere from 102° of crankshaft rotation to 282° of crankshaft rotation. The minimum decoding interval of 102° is simply the observation window period, whereas the maximum decoding interval of 282° represents the case where 180° of crankshaft rotation transpire before a falling pulse edge of the CAM signal can be detected. This is in contrast to the traditional cam decoding method outlined above in reference to FIG. 1 where the minimum decoding interval is 360° of crankshaft rotation, and the maximum intervals is 540° of crankshaft rotation.

Figure 5:
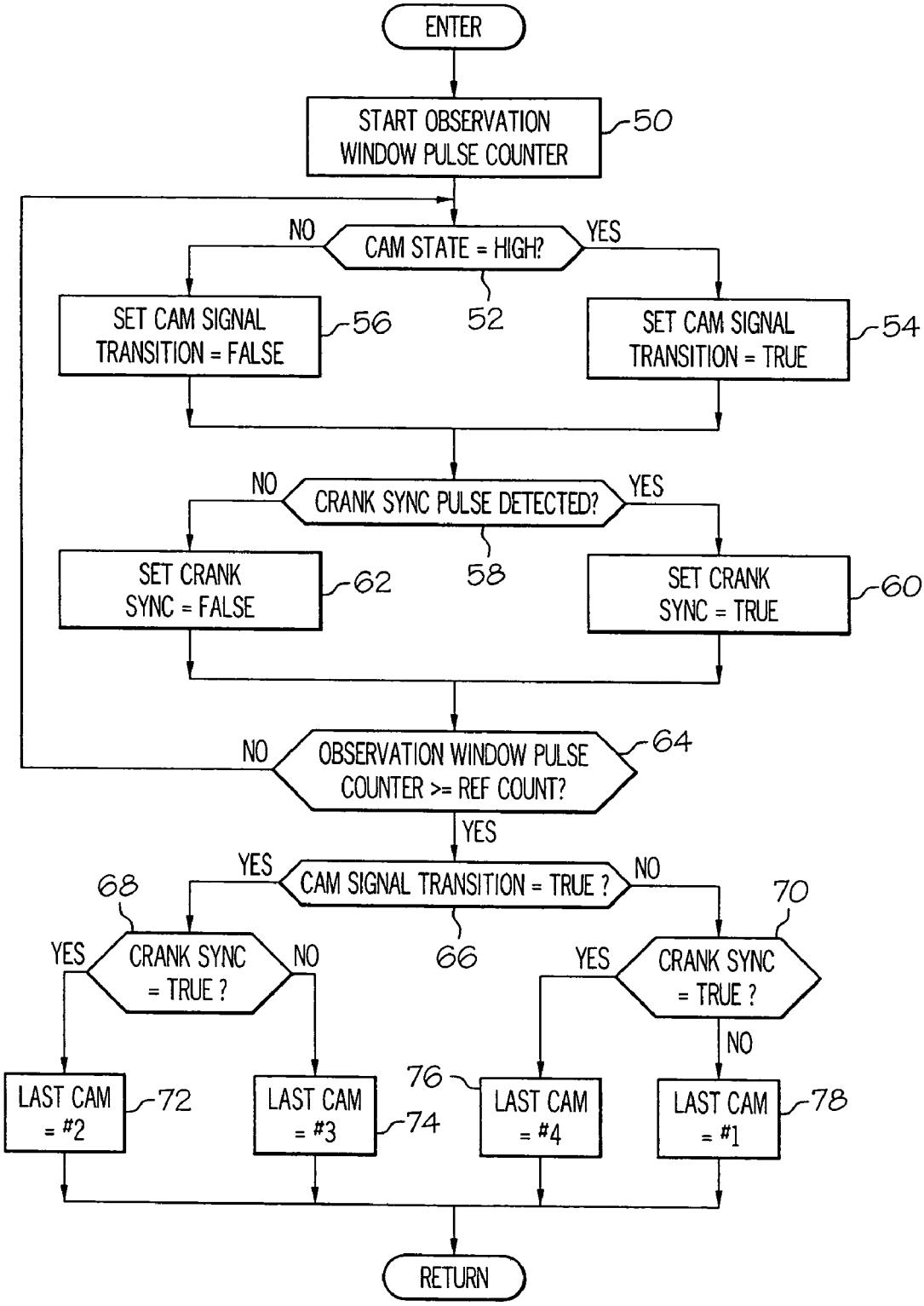
FIG. 5 is a flow diagram representative of a software routine executed by the ECM of FIG. 2 for carrying out the method of this invention.

The flow diagram of FIG. 5 represents an interrupt service routine executed by ECM 30 when the first falling pulse edge of the CAM signal is detected during engine cranking. The block 50 is first executed to reset an Observation Window Pulse Counter that counts pulses of the CRANK signal. The blocks 52, 54, 56, 58, 60 and 62 are then executed to monitor for a CAM signal pulse transition (specifically, a rising pulse edge) and a CRANK signal sync pulse. The presence or absence of a CAM signal transition is reflected by the state of a CAM SIGNAL TRANSITION flag, while the presence or absence of a CRANK signal sync pulse is reflected by the state of a CRANK SYNC flag. Block 64 compares the Observation Window Pulse Counter to a reference count such as 17 pulses, and requires re-execution of blocks 52-62 until the observation window period has expired. After expiration of the observation window period, the blocks 66, 68, 70, 72, 74, 76 and 78 are executed to perform the decode logic represented by the table of FIG. 4 based on the states of the CAM SIGNAL TRANSITION and CRANK SYNC flags, completing the routine.

In summary, the method of the present invention significantly reduces the time required to decode a pulse width encoded CAM signal for a four-stroke internal combustion engine, enabling more prompt engine starting. While the present invention has been described with respect to the illustrated embodiment, it is recognized that numerous modifications and variations in addition to those mentioned herein will occur to those skilled in the art. For example, the method may be applied to engines having any number of cylinders, or cam-wheel and crank-wheel tooth patterns different than shown herein, and so on. Accordingly, it is intended that the invention not be limited to the disclosed embodiment, but that it have the full scope permitted by the language of the following claims.

The invention claimed is:

1. A position decoding method for a four-stroke internal combustion engine, comprising the steps of:

producing a CAM signal based on rotation of a camshaft of said engine, the CAM signal having a series of four width-encoded pulses per cycle of said engine;

producing a CRANK signal based on rotation of a crankshaft of said engine, the CRANK signal having a series of pulses and a sync feature;

defining an observation window with respect to a first pulse transition of said CAM signal, said observation window extending for a predefined angle of crankshaft rotation;

producing a first indication based on whether a second pulse transition occurs in said CAM signal during said observation window and a second indication based on whether said sync feature occurs in said CRANK signal during said observation window, whereby a different combination of said first and second indications occurs for each of the width-encoded pulses of said CAM signal; and decoding the width-encoded pulses of said CAM signal based on said first indication and said second indication.

2. The position decoding method of claim 1, including the steps of:

detecting said first pulse transition of said CAM signal during cranking of said engine; and commencing said observation window with respect to the detection of said first pulse transition, and thereafter terminating said observation window when said crankshaft has rotated through said predefined angle.

3. The position decoding method of claim 1, wherein said predefined angle is defined as a predefined number of pulses of said CRANK signal.

* * * * *